US010395628B2

(12) United States Patent
Rovner

(10) Patent No.: US 10,395,628 B2
(45) Date of Patent: Aug. 27, 2019

(54) FLANGED TONE CHAMBER WINDOW FOR WOODWIND MOUTHPIECES

(71) Applicant: ROVNER PRODUCTS INCORPORATED, Timonium, MD (US)

(72) Inventor: Philip Lee Rovner, Timonium, MD (US)

(73) Assignee: ROVNER PRODUCTS INCORPORATED, Timonium, MD (US)

( * ) Notice: Subject to any disclaimer, the term of this patent is extended or adjusted under 35 U.S.C. 154(b) by 24 days.

(21) Appl. No.: 15/862,980

(22) Filed: Jan. 5, 2018

(65) Prior Publication Data

US 2019/0213980 A1 Jul. 11, 2019

(51) Int. Cl.
*G10D 9/02* (2006.01)
*G10D 7/06* (2006.01)

(52) U.S. Cl.
CPC ..... *G10D 9/02* (2013.01); *G10D 7/06* (2013.01)

(58) Field of Classification Search
CPC ..... G10D 9/02; G10D 7/06
See application file for complete search history.

(56) References Cited

U.S. PATENT DOCUMENTS

| | | | |
|---|---|---|---|
| 1,667,836 | A | 5/1928 | Brockman, Jr. |
| 1,771,157 | A | 7/1930 | Paul |
| 1,809,380 | A | 6/1931 | Gulick |
| 2,003,576 | A | 6/1935 | Buhren |
| 2,095,605 | A | 10/1937 | Georges |
| 2,181,880 | A | 12/1939 | Fauss |
| 2,224,308 | A | 12/1940 | Maccaferri |
| 2,287,529 | A | 6/1942 | Mario |
| 2,296,737 | A | 9/1942 | Peterson |
| 2,368,556 | A | 1/1945 | Maccaferri |
| 2,411,692 | A | 11/1946 | Murano |
| 2,495,484 | A | 1/1950 | Schemenauer |
| 2,499,855 | A | 3/1950 | Gamble |
| 2,517,077 | A | 8/1950 | Berry |
| 2,525,523 | A | 10/1950 | Chance |
| 3,150,554 | A | 9/1964 | Leloup |

(Continued)

FOREIGN PATENT DOCUMENTS

FR 2613521 A1 10/1988

OTHER PUBLICATIONS

Article excerpts from"Downbeat" and "Clarinet Magazine" discussing the Rovner Barrel, 1979.

(Continued)

*Primary Examiner* — Kimberly R Lockett
(74) *Attorney, Agent, or Firm* — Patent Portfolio Builders PLLC

(57) ABSTRACT

A woodwind mouthpiece has a tone chamber in communication with a central bore running through the mouthpiece and a window exposing the tone chamber. A table is located at a first end of the window, and a tip rail is located at a second end of the window opposite the first end. A pair of side rails run along opposite sides of the window from the table to the tip rail. Each side rail includes a side rail top surface. A pair of flanges are provided in the mouthpiece such that each flange extending out from one of the side rail top surfaces in a direction opposite the window. This arrangement reduces the intensity of the shock fronts at the aperture into the tone chamber.

20 Claims, 4 Drawing Sheets

(56) References Cited

U.S. PATENT DOCUMENTS

| | | | |
|---|---|---|---|
| 3,433,113 | A | 3/1969 | Portnoy |
| 3,521,517 | A | 7/1970 | Sato |
| 3,759,132 | A | 9/1973 | Backus |
| 3,905,268 | A | 9/1975 | Gamble |
| 4,056,997 | A | 11/1977 | Rovner |
| 4,210,055 | A | 7/1980 | Platamone, Jr. |
| 4,308,781 | A | 1/1982 | McGuerty |
| 4,337,683 | A | 7/1982 | Backus |
| 4,428,271 | A | 1/1984 | Winslow et al. |
| 4,449,439 | A | 5/1984 | Wells |
| 4,517,875 | A | 5/1985 | Dossekker |
| 4,651,616 | A | 3/1987 | Visser |
| 4,669,352 | A | 6/1987 | Bichon |
| 4,708,182 | A | 11/1987 | Laker |
| 4,745,838 | A | 5/1988 | Johnson |
| 4,941,385 | A | 7/1990 | Johnson |
| 5,018,425 | A | 5/1991 | Rovner |
| 5,105,701 | A | 4/1992 | Hall et al. |
| 5,192,821 | A | 3/1993 | Goldstein et al. |
| 5,289,752 | A | 3/1994 | Barbaglia |
| 5,293,805 | A | 3/1994 | Guardala et al. |
| 5,303,628 | A | 4/1994 | Salazar |
| 5,357,837 | A | 10/1994 | Disera |
| 5,398,582 | A | 3/1995 | Smith |
| 5,419,229 | A | 5/1995 | Van Doren |
| 5,456,152 | A | 10/1995 | Cusack et al. |
| 5,623,111 | A | 4/1997 | Van Doren et al. |
| 5,728,957 | A | 3/1998 | Valtchev |
| D404,755 | S | 1/1999 | Garbuzov |
| 5,973,245 | A | 10/1999 | Van Doren |
| 5,998,715 | A | 12/1999 | Rovner |
| 6,020,545 | A | 2/2000 | Consoli |
| 6,118,060 | A | 9/2000 | Van Doren |
| 6,130,376 | A | 10/2000 | Chang |
| 6,150,593 | A | 11/2000 | Holden |
| 6,259,010 | B1 | 7/2001 | Nagahara |
| 6,501,010 | B2 | 12/2002 | Sullivan |
| 6,673,992 | B1 | 1/2004 | Runyon |
| 7,169,993 | B2 | 1/2007 | Fliegel et al. |
| 7,326,840 | B2 | 2/2008 | Wanne |
| 7,465,864 | B2 | 12/2008 | Heintz |
| 7,470,844 | B2 | 12/2008 | Espina |
| 7,626,105 | B2 | 12/2009 | Rovner |
| 7,635,287 | B2 | 12/2009 | May |
| 7,638,700 | B1 | 12/2009 | Heintz |
| 7,667,118 | B1 | 2/2010 | Behn |
| 7,825,317 | B1 | 11/2010 | Lederman et al. |
| 7,863,509 | B2 | 1/2011 | Rovner |
| 7,939,738 | B2 | 5/2011 | Rovner |
| 7,982,112 | B2 | 7/2011 | Rovner |
| 8,283,541 | B2 | 10/2012 | Rovner |
| 8,410,344 | B2 | 4/2013 | Rovner |
| 8,586,845 | B2 | 11/2013 | Rovner |
| 8,841,529 | B2 | 9/2014 | Rovner |
| 2004/0011183 | A1 | 1/2004 | Fliegel et al. |
| 2005/0061136 | A1 | 3/2005 | Rovner |
| 2005/0061137 | A1 | 3/2005 | Rovner |
| 2005/0072623 | A1 | 4/2005 | Rovner |
| 2005/0087057 | A1 | 4/2005 | Taillard |
| 2006/0123973 | A1 | 6/2006 | Espina |
| 2006/0272473 | A1 | 12/2006 | Kuo |
| 2008/0022839 | A1 | 1/2008 | Sullivan |
| 2009/0217798 | A1 | 9/2009 | Rovner |
| 2009/0217800 | A1 | 9/2009 | Rovner |
| 2010/0043621 | A1 | 2/2010 | Rovner |
| 2011/0162508 | A1 | 7/2011 | Rovner |
| 2011/0239843 | A1 | 10/2011 | Brockman |
| 2018/0134349 | A1 | 5/2018 | Bowler |
| 2018/0166050 | A1 | 6/2018 | Rovner et al. |

OTHER PUBLICATIONS

Passband, http://www.absoluteastronomy.com/topics/Passband viewed May 14, 2010.

Rovner ligatures, viewed May 14, 2010 at www.rovnerproducts.com/ligatures.com.

FLANGED TONE CHAMBER WINDOW FOR WOODWIND MOUTHPIECES

FIELD OF THE INVENTION

The present invention relates to woodwind instruments and in particular to mouthpieces for woodwind instruments.

BACKGROUND OF THE INVENTION

Woodwind musical instruments, e.g., saxophones and clarinets, and other devices such as bird calls, utilize the vibration of a reed in response to a flow of air to generate a tone. These reeds include natural cane reeds and synthetic reeds. Tone generation in general depends on proper reed vibration. The reed is typically placed in contact with a mouthpiece to cover an opening or window. The reed is held in place by an adjustable clamp or ligature that surrounds the mouthpiece and the reed. Variations in the mouthpiece and ligature affect the vibration of the reed and, therefore, the performance or tone of the device or instrument.

The essential function of the mouthpiece of a woodwind instrument is to provide support for the reed over an aperture that allows the reed to vibrate and to direct the energy from the reed vibration through the aperture and into the bore of the instrument. The function and performance of a mouthpiece is influenced by the arrangement and geometry of the facing around the aperture as well as tone chamber below the reed, which defines the route from the aperture to the bore. The facing was conventionally a flat surface on the mouthpiece surrounding the aperture, and the reed is placed in contact with this flat surface, covering the aperture. The facing includes the aperture, called a window, and the window is surrounded by a table on one end, two side rails extending from the table and a tip rail opposite the table. The reed functions as a reed valve during vibration, opening and closing the window.

The reed includes a heel end that is positioned over the table of the mouthpiece. The bottom surface of the reed extends along the top surfaces of side rails that extend from the table along either side of the window that exposes the tone chamber. The reed tapers to a reed tip that is positioned over the tip rail of the mouthpiece. The tip rail extends between the side rails at the end of the tone chamber opposite the table. An aperture is formed by the reed tip and the tip rail. This aperture also extends along the reed a portion of the length of each side rail from the tip rail. This aperture or gap is an abrupt opening. The abrupt opening induces a high acoustic impedance and generates the formation of intense shock fronts that inhibit the flow of the airstream through the aperture between the reed tip and the tip rail. The shock fronts extend from the bottom of the reed to the side rail top surfaces and tip rail and are generally perpendicular to the direction of propagation of air and vibrations through the aperture and into the tone chamber.

The generated shock fronts degrade the resonance level of the woodwind instrument. The performance level of the woodwind instrument in terms of the characteristics of power, sonority, intonation and articulation is also degraded. In addition to the shock front generated by the tip aperture, the shape of the tone chamber below the reed can produce additional shock fronts that further degrade the performance level of the woodwind instrument. Therefore, modifications to the shape of the mouthpiece around the tip rail and in the tone chamber are desired that improve the performance level of the instrument.

SUMMARY OF THE INVENTION

The present invention is directed to mouthpieces for woodwind instruments with modifications that soften the abrupt or perpendicular shock fronts at the aperture defined between the reed and each one of the tip rail and side rail top surfaces. In addition, the shape of the tone chamber is modified. During operation of the mouthpiece, the reed functions as a reed valve, opening and closing the gap or aperture in oscillatory cooperation with the air column of the instrument. During any portion of the oscillatory cycle, the gap is either fully open, partially open or barely open. Configurations of the aperture and tone chamber that generate shock fronts degrade the flow of the airstream, which is a dampening factor that reduces the "Q" of the oscillating system. The "Q" is a quality factor that provides a measure of underdamping in the oscillating system of the mouthpiece and reed. In addition, the quality factor can express the bandwidth of frequencies passing through the oscillating system relative to the central frequency of the oscillating system.

In accordance with one exemplary embodiment, the present invention provides a woodwind mouthpiece containing a central bore passing through the mouthpiece and a tone chamber in communication with the central bore and having a bottom surface. A window, i.e., opening, is provided to expose the tone chamber. A table configured to engage the heel end of the reed is disposed at one end of the tone chamber, i.e., the end of the tone chamber in communication with the central bore. A pair of side rails extend from the table along opposite sides of the window. A tip rail extends between the side rails at another end of the tone chamber opposite the table. Therefore, the tone chamber extends from the central bore to the tip rail.

Each side rail includes a side rail top surface and an interior surface, i.e., interior to the tone chamber, running from the top surface of the side rail to the bottom surface of the tone chamber. Exemplary embodiments modify the side rail top surface, the interior surfaces of the tone chamber and the bottom surface of the tone chamber to reduce the abruptness of the aperture or opening to the gap between the reed and the mouthpiece, reducing the impedance mismatch and lowering the intensity of the shock fronts. In general, the surfaces are modified to create a tapered or funnel shaped transitions, yielding a venturi that softens the shock intensity and enabling a higher mass flow of airstream through the gap or aperture. The shape of the tone chamber also has the tapered or funnel shape to reduce abrupt changes in impedance within the tone chamber and to utilize the benefit of a "shaped charge" effect that improves the focus of the pressure zones in the chamber against the reed.

Exemplary embodiments improve the airflow through the aperture defined between the bottom of the reed and each top rail by effecting a geometry of the external surface of the mouthpiece at the inlet to the aperture, i.e., at extending in from the outer surface of the mouthpiece. This effectively forms a funnel, or venturi inlet, that reduces the intensity of the shock front that forms at the inlet of a more abrupt geometry. This configuration provides an improvement in overall performance results from such a configuration. In one embodiment, the width of the funnel shapes on the inlet surfaces of the mouthpiece is a function of the gap width of the mouthpiece and is selected to effect a 29.8° included angle to the perpendicular place of the gap at the contact points of the reed and mouthpiece. This angle is derived from the standard divergent angle of rocket exhaust flares, which has been determined to be the angle which transforms the impedance between the rocket nozzle and the outside environment.

With the reed placed over the window and in contact with the side rails and tip rail of the mouthpiece, the station of the tip region where an aperture is formed is the region up to about the first 25 mm, (1 inch) of the tip of the mouthpiece. The direction of airflow during the negative-pressure portion of the oscillation of the reed is from the outer surface of the mouthpiece across the tip rails and the side rails and into the window of the tone chamber. Therefore, the interface between the outer surface of the mouthpiece and the top surfaces of the side rails affects the functioning of the aperture. An abrupt geometry is not conducive to enabling an efficient flow of air through the aperture as this abrupt geometry produces shock fronts perpendicular to the direction of flow of the column of air. Therefore, exemplary embodiments provide a flange extending from the window and preferably angled away from the side rail top surfaces and tip rail. In addition, the interior surfaces of the tone chamber are also sloped or tapered. This forms a beveled or slope surface defining a funnel or venturi inlet that more effectively induces airflow through the aperture during the negative-pressure portion of the oscillatory cycle. The shock fronts extending from the bottom of the reed migrate along these tapered or sloped surfaces, producing shock fronts that are not perpendicular to the direction of flow of the air column. This reduces damping of the system, resulting in an improvement in performance.

Exemplary embodiments are directed to a woodwind mouthpiece having a tone chamber in communication with a central bore running through the mouthpiece, a window exposing the tone chamber, a table at a first end of the window and a tip rail at a second end of the window opposite the first end, a pair of side rails running along opposite sides of the window from the table to the tip rail, and a pair of flanges. Each side rail has a side rail top surface, and each flange extends out from one of the side rail top surfaces in a direction opposite the window. In one embodiment, the flanges are coplanar with the side rail top surfaces. In another embodiment, the flanges extend at an angle from a plane containing the side rail top surfaces.

Each side rail top surface has a side rail length from the table to the tip rail, and each flange extends along only a portion of the side rail length of one of the side rail top surfaces. In one embodiment, each flange extends along one of the side rail top surface up to about 15 mm to about 16 mm. In one embodiment, each flange extends from one of the side rail top surfaces by a flange width. For example, the flange width is up to about 4 mm. In one embodiment, each flange extends along one of the side rail top surfaces from a point of intersection of the side rail top surface and a tip rail top surface, and the flange width decreases along the flange from the point of intersection.

In one embodiment, the tip rail includes a tip rail top surface, and each flange extends out from a portion of the tip rail top surface in a direction opposite the window. In one embodiment, each flange extends out from a portion of the tip rail top surface having a length up to about 9 mm. In one embodiment, the flanges are spaced from each other along the tip rail. For example, the flanges are spaced from each other by a separation distance up to about 2 mm. In one embodiment, each flange extends from at least one of the tip rail top surface by a flange width, the flange width constant along the tip rail. For example, the flange width is up to about 3 mm.

In one embodiment, the window is disposed on a bottom of the mouthpiece, and each flange extends from the tip rail top surface away from the bottom at an angle to a plane containing the tip rail top surfaces. In one embodiment, each flange has a flange thickness measured from the tip rail top surface of up to about 3 mm. In one embodiment, each side rail has an interior surface running from the side rail top surface to a bottom surface of the tone chamber, and the tone chamber has a tone chamber width defined by a distance between the interior surfaces of the side rails. The tone chamber width greater is at the side rail top surface than at the bottom surface of the tone chamber. The bottom surface has a bottom surface width defined by a distance between the interior surfaces of the side rails at the bottom surface. The bottom surface width varies from the second end of the tone chamber adjacent the tip rail to the first end of the tone chamber adjacent the table.

In one embodiment, the tone chamber width is greater at the side rail top surface than at the bottom surface of the tone chamber along only a portion of an entire length of the tone chamber from the tip rail to the central bore. In one embodiment, the bottom surface width has a first width at the first end of the tone chamber, a second width at the second end of the tone chamber and a third width at a point along the tone chamber between the first end and the second end. The third width is less than the first width and the second width. In addition, the bottom surface tapers from the first width to the third width and the third width to the first width, and the point along the tone chamber is disposed closer to the second end. In one embodiment, the tone chamber has a tapered cross section from side rail to side rail, and the bottom surface comprises a tapered shape from the first end to the second end.

DETAILED DESCRIPTION

Figure 1:
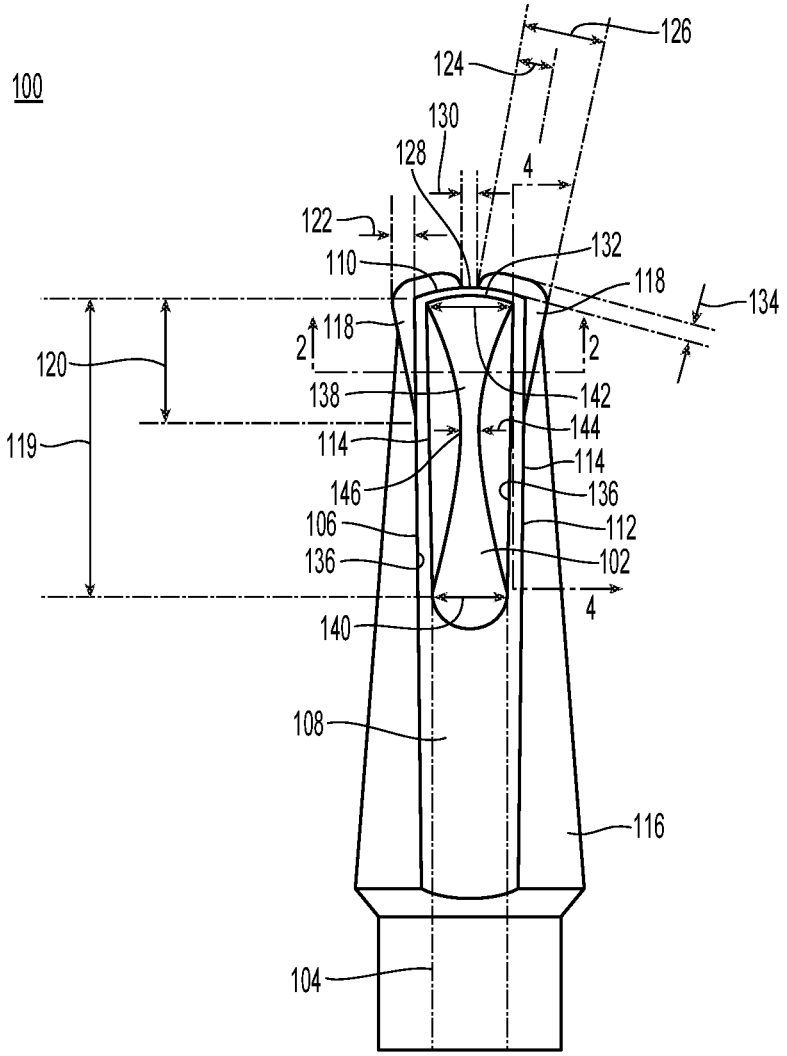
FIG. 1 is a plan view of a bottom side of an embodiment of a mouthpiece in accordance with the present invention.

Referring initially to FIG. 1, an exemplary embodiment of a woodwind mouthpiece 100 in accordance with the present invention is illustrated. The view of the mouthpiece is from the side of the mouthpiece configured to engage a reed. This side of the mouthpiece is called the bottom of the mouthpiece as this side is positioned pointing downward or on the bottom when the mouthpiece is attached to a saxophone or clarinet. The woodwind mouthpiece includes a tone chamber 102 in communication with a central bore 104 running through the mouthpiece.

The mouthpiece also includes a window 106 exposing the tone chamber 102 disposed within the mouthpiece. The mouthpiece includes a table 108 at a first end of the window and a tip rail 110 at a second end of the window opposite the first end. A pair of side rails 112 extend from the table and run along opposite sides of the window from the table to the tip rail. Each side rail includes a side rail top surface 114. The window 106 is a generally rectangular window, and in one embodiment, the window narrows from the tip rail 110 at the second end of the mouthpiece or window to the table 108 at the second end of the window. The table, which is in contact with the window, is configured to engage a reed and in particular, the heel end of the reed. A ligature (not shown) is placed around the reed and the outer surface 116 of the mouthpiece at the table to secure the reed to the mouthpiece. The window transitions to the table at a table end of the window opposite the first end. Conventionally, this transition between the window and the table is straight, i.e., perpendicular to the central axis, or is effectively straight, having only a slight curvature.

The mouthpiece includes at least one and preferably a pair of flanges 118. Each flange extends out from one of the side rail top surfaces in a direction opposite the window, i.e., from the side of the top rail surface that is adjacent the outer surface of the mouthpiece and opposite the window. In one embodiment, the flanges overlap at least a portion of the side rail top surfaces. Alternatively, the flanges extend completely over the side rail top surfaces. In one embodiment, the flanges extend from and are coplanar with the side rail top surfaces. Preferably, the flanges extend at an angle from a plane containing the side rail top surfaces. The flanges can be formed and molded together with the mouthpiece to form a single, unitary structure. Alternatively, the flanges are separate structures attached to the mouthpiece, for example, using adhesives. In one embodiment, the flanges are releasably attached to the mouthpiece. In one embodiment, the flanges are formed with or attached to the mouthpiece, and the desired angle between the flanges and the plane containing the side rail top surfaces is polished or machined into the flanges.

Each side rail top surface has a side rail length 119 from the table to the tip rail. In one embodiment, the side rail length is about 35 mm to about 42 mm (1.4 inches to 1.6 inches). Each flange extends along one of the side rails from the point of intersection between the side rail and the tip rail. Preferably, each flange extends along only a portion of the side rail length. In one embodiment, each flange extends along one of the side rail top surfaces by a distance 120 that is less than about 25.4 mm (1 inch). Preferably, the distance is up to about 15 mm to about 16 mm (0.59 inches to 0.63 inches).

Each flange extends from one of the side rail top surfaces to a flange width 122. This flange width can be constant along the distance each flange extends along the side rail top surface. Preferably, the flange width varies along the distance each flange extends along the side rail top surface. In one embodiment, the flange width is greatest or thickest at the point of intersection of the side rail and tip rail and decreases along the side rail. In one embodiment, the width decreases to about zero at the distance each flange extends along the side rail top surface. In one embodiment, the flange width 122 is up to about 4 mm (0.16 inches), for example, from about 3 mm (0.12 inches to about 4 mm. In combination with the width of the top surface of the side rail, the overall width of the side rail top surface and flange is up to about 5 mm (0.2 inches).

In one embodiment, each flange is located only along one of the side rails and extends from the portion of intersection between the side rail and tip rail. Preferably, each flange wraps around the point of intersection between the side rail and tip rail and extends out from a portion of the tip rail top surface. Alternatively, the mouthpiece includes one of more separate tip rail flanges, each extending out from a portion of the tip rail top surface. In one embodiment, each flange extends along only a portion of the tip rail. In one embodiment, the portion of the tip rail along which the flange extends has a length 124 up to about 9 mm (0.35 inches). When combined with the width of the flange along the side rail, the portion has an overall length 126 of up to about 12 mm to about 13 mm (0.47 inches to 0.51 inches).

In one embodiment, the flanges do not extend completely across the tip rail either individually or in combination. Therefore, the flanges are spaced from each other along the tip rail. This leaves an exposed portion 128 of the tip rail. In one embodiment, this exposed portion of the tip rail has a size 130 of from about 1 mm to about 2 mm (0.04 inches to 0.08 inches). Therefore, the flanges are spaced from each other by a separation distance of up to about 2 mm (0.08 inches). Leaving the exposed portion of the tip rail provides an alignment edge of the tip of the reed. In one embodiment, the flanges are curved or tapered into the exposed portion. Therefore, a finger or fingernail can be inserted against the tip rail to align the tapered end of the reed with the tip rail. This facilitates proper alignment of the reed over the window. Each flange extends from the tip rail top surface 132 by a flange width 134. In one embodiment, the flange width constant along the tip rail. Alternatively, the flange width varies along the tip rail. In one embodiment, the flange width is up to about 3 mm (0.12 inches).

Each side rail on a side adjacent the window has an interior surface 136 that runs from the side rail top surface to a bottom surface 138 of the tone chamber. The tone chamber width is defined by a distance between the interior surfaces of the side rails. The tone chamber width can be constant or can vary from the side rail top surfaces to the bottom surface and from the table to the tip rail. In one embodiment, the tone chamber width is larger at the side rail top surface than at the bottom surface of the tone chamber. In one embodiment, the tone chamber width is greater at the side rail top surface than at the bottom surface of the tone chamber along only a portion of an entire length of the tone chamber from the tip rail to the central bore.

The bottom surface width is defined by a distance between the interior surfaces of the side rails at the bottom surface. The bottom surface width varies from the second end of the tone chamber adjacent the tip rail to the first end of the tone chamber adjacent the table. In one embodiment, the bottom surface width includes a first width 140 at the first end of the tone chamber, a second width 142 at the second end of the tone chamber and a third width 144 at a point 146 along the tone chamber between the first end and the second end. The bottom surface tapers from the first width to the third width and the third width to the first width. In one embodiment, the second width is larger than the first width. In addition, the third width is less than the first width and the second width. In one embodiment, the first width is up to about 10 mm (0.4 inches), and the second width is up to about 15 mm (0.59 inches). In one embodiment, the third width is from about zero to about 1 mm (0.04 inches). The point along the tone chamber can be any distance between the first and the second end. Preferably, the point along the tone chamber disposed closer to the second end. In one embodiment, the point along the tone chamber is located a distance of from about 11 mm (0.43 inches) to about 12 mm (0.47 inches) from the second end. As the point along the tone chamber is located closer to the second end, and the second width is greater than the first width, the taper or slope from the point along the tone chamber to the second end is greater or larger than from the point along the tone chamber to the first end. These changes in tone chamber width from table to tip rail and top surface to bottom surface yield a tone chamber with a tapered cross section from side rail to side rail and a bottom surface with a tapered shape from the first end to the second end.

Figure 2:
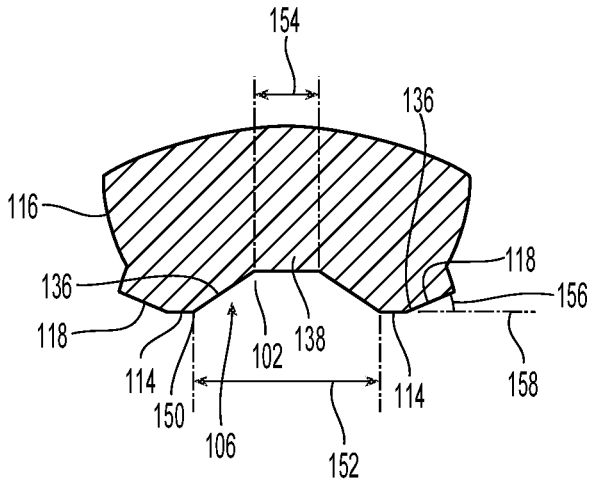
FIG. 2 is a view through line 2-2 of FIG. 1 with the bottom side facing downwards.

Referring now to FIG. 2, the window 106 exposing the tone chamber 102 is positioned or disposed on the bottom 150 of the mouthpiece. The interior surfaces 136 of the tone chamber slope or taper from a side rail top surface width 152 between the side rail top surfaces 114 and a bottom surface width 154 at the bottom surface 138 of the tone chamber. The side rail top surface width is larger than the bottom surface width. In addition, each flange extends from the tip rail top surface away from the bottom at an angle 156 to a plane 158 containing the tip rail top surfaces, i.e., away from the bottom of the mouthpiece. In one embodiment, this angle is up to about 29.8°, which is the maximum angle likely to occur in the shock front.

Figure 3:
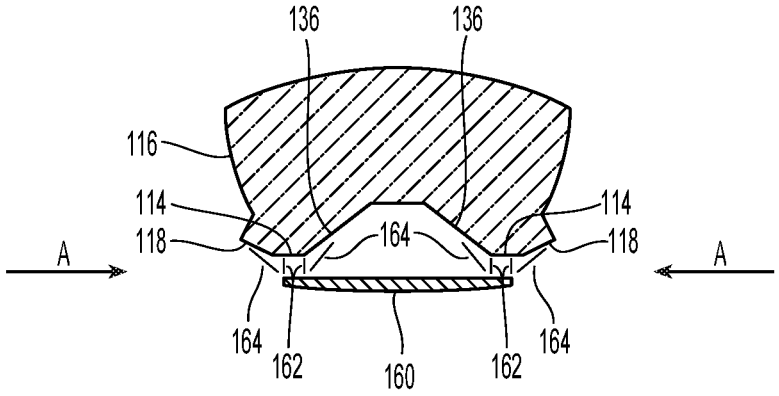
FIG. 3 is the view of FIG. 2 showing a reed positioned over the tone chamber to define the apertures.

Referring to FIG. 3, a reed 160 is positioned over the window. Without the flanges and the tapered interior surfaces, the shock fronts 162 extend from the bottom surface of the reed to the side rail top surfaces 114. These conventional shock fronts are perpendicular to the direction of air flow into the tone chamber as indicated by arrows A. The sloped surfaces of the flanges 118 and the interior surfaces 136 of the tone chamber provide for migrated shock fronts 164 extending from the bottom surface of the reed along the slope surfaces of the flanges and interior surfaces. These migrated shock fronts are not perpendicular to the direction of air flow.

Figure 4:
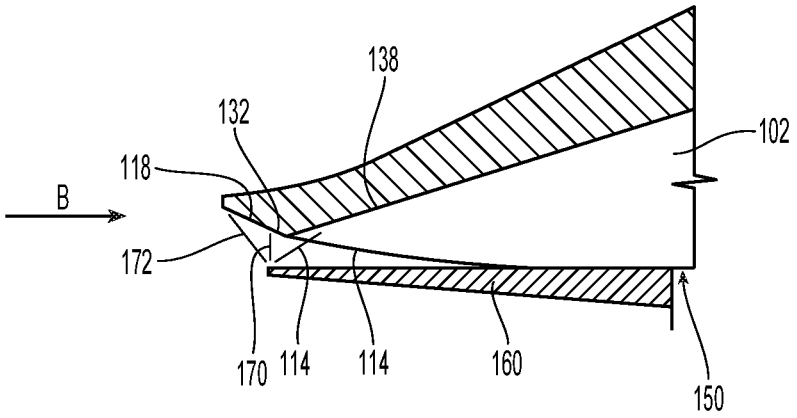
FIG. 4 is a view through line 4-4 of FIG. 1 with a reed positioned over the tone chamber to define the apertures.

Referring to FIG. 4, the reed 160 is positioned over the window of the tone chamber 102 on the bottom surface 150 of the mouthpiece and is aligned with the tip rail top surface 132. Without the flanges and the tapered interior surfaces, the shock front 170 extends from the bottom surface of the reed to the tip rail top surface 132. This conventional shock front is also perpendicular to the direction of air flow into the tone chamber across the aperture between the reed and the tip rail as indicated by arrow B. The sloped surfaces of the flanges 118 and the bottom surface 138 of the tone chamber provide for migrated shock fronts 172 extending from the bottom surface of the reed along the slope surfaces of the flanges and bottom surface. These migrated shock fronts are not perpendicular to the direction of air flow.

Figure 5:
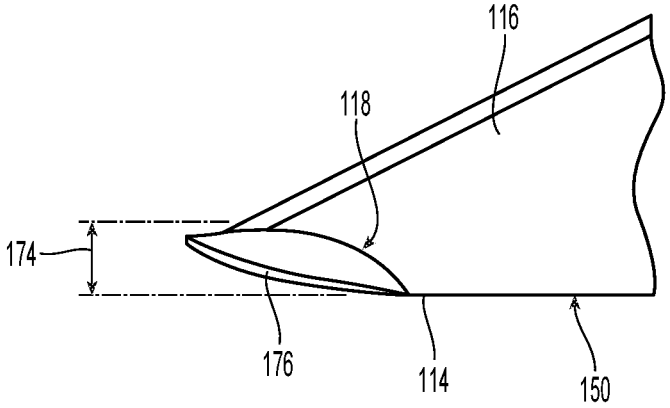
FIG. 5 is a partial side view of the mouthpiece showing a flange.
Figure 6:
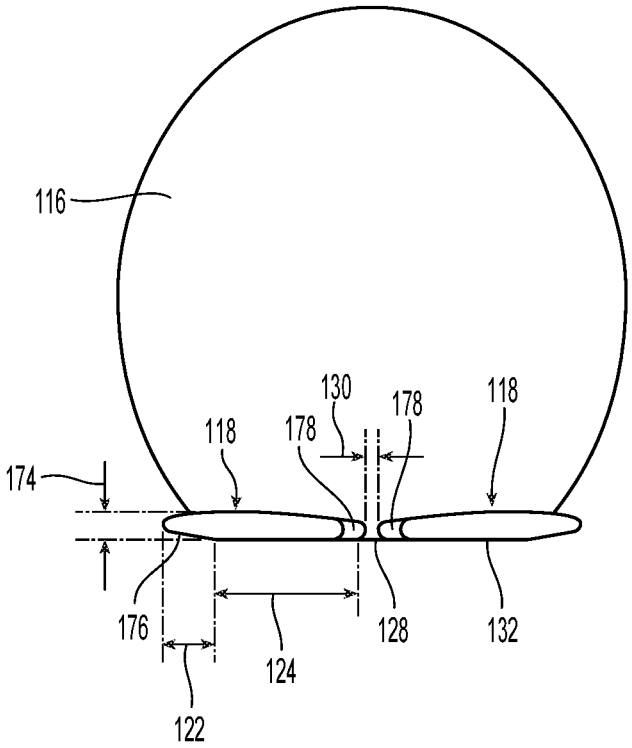
FIG. 6 is an end view of the mouthpiece from the tip rail end showing the pair of flanges extending along the tip rail.

Referring now to FIGS. 5 and 6, each flange has a flange thickness 174 measured from the tip rail top surface 132 or side rail top surface 114. The surface 176 of the flange extending away from the tip rail top surface or side rail top surface is within this thickness. In one embodiment, the flange thickness is up to about 3 mm (0.12 inches). The flange thickness can be constant along the side rails and tip rail or can vary. In addition, the flange thickness can be constant along the length 124 of the flange along the tip rail or the flange width 122 extending from the tip rail top surfaces. In one embodiment, the flange thickness decreases near the exposed portion 128 of the tip rail. In addition, the flanged width is decreased to provide a tapered surface 178 on each flange that effectively increases the size 130 of the exposed portion away from the tip rail to facilitate insertion of a finger or fingernail for reed alignment with the tip rail.

The present invention is also directed to methods for making or creating a woodwind mouthpiece that takes advantage of the gap provided at the aperture between the reed and the tone chamber. A tone chamber is formed in the mouthpiece in communication with the central bore. This tone chamber includes a bottom surface and a pair of opposing interior surfaces extending from the bottom surface. A window is formed in the mouthpiece in communication with the tone chamber. This window exposes the tone chamber. In one embodiment, a pair of flanges are formed to run along a portion of the length of each one of the side rails and at least a portion of the tip rail. Each flange has a surface that intersects the side rail top surface and tip rail top surface of the mouthpiece.

While it is apparent that the illustrative embodiments of the invention disclosed herein fulfill the objectives of the present invention, it is appreciated that numerous modifications and other embodiments may be devised by those skilled in the art. Additionally, feature(s) and/or element(s) from any embodiment may be used singly or in combination with other embodiment(s) and steps or elements from methods in accordance with the present invention can be executed or performed in any suitable order. Therefore, it will be understood that the appended claims are intended to cover all such modifications and embodiments, which would come within the spirit and scope of the present invention.

What is claimed is:

1. A woodwind mouthpiece comprising:
- a tone chamber in communication with a central bore running through the mouthpiece;
- a window exposing the tone chamber;
- a table at a first end of the window and a tip rail at a second end of the window opposite the first end;
- a pair of side rails running along opposite sides of the window from the table to the tip rail, each side rail comprising a side rail top surface; and
- a pair of flanges, each flange extending out from one of the side rail top surfaces in a direction opposite the window.

2. The woodwind mouthpiece of claim 1, wherein the flanges are coplanar with the side rail top surfaces.

3. The woodwind mouthpiece of claim 1, wherein the flanges extend at an angle from a plane containing the side rail top surfaces.

4. The woodwind mouthpiece of claim 1, wherein:
- each side rail top surface comprises a side rail length from the table to the tip rail; and
- each flange extends along only a portion of the side rail length of one of the side rail top surfaces.

5. The woodwind mouthpiece of claim 1, wherein each flange extends along one of the side rail top surface up to about 15 mm to about 16 mm.

6. The woodwind mouthpiece of claim 1, wherein each flange extends from one of the side rail top surfaces by a flange width.

7. The woodwind mouthpiece of claim 6, wherein the flange width is up to about 4 mm.

8. The woodwind mouthpiece of claim 7, wherein:
- each flange extends along one of the side rail top surfaces from a point of intersection of the side rail top surface and a tip rail top surface; and
- the flange width decreases along the flange from the point of intersection.

9. The woodwind mouthpiece of claim 1, wherein:
- the tip rail comprises a tip rail top surface; and
- each flange extends out from a portion of the tip rail top surface in a direction opposite the window.

10. The woodwind mouthpiece of claim 9, wherein each flange extends out from a portion of the tip rail top surface having a length up to about 9 mm.

11. The woodwind mouthpiece of claim 9, wherein the flanges are spaced from each other along the tip rail.

12. The woodwind mouthpiece of claim 11, wherein the flanges are spaced from each other by a separation distance up to about 2 mm.

13. The woodwind mouthpiece of claim 9, each flange extends from at least one of the tip rail top surface by a flange width, the flange width constant along the tip rail.

14. The woodwind mouthpiece of claim 13, wherein the flange width is up to about 3 mm.

15. The woodwind mouthpiece of claim 9, wherein:

the window is disposed on a bottom of the mouthpiece; and each flange extends from the tip rail top surface away from the bottom at an angle to a plane containing the tip rail top surfaces.

16. The woodwind mouthpiece of claim 1, wherein each flange comprises a flange thickness measured from the tip rail top surface up to about 3 mm.

17. The woodwind mouthpiece of claim 1, wherein each side rail comprises an interior surface running from the side rail top surface to a bottom surface of the tone chamber;

the tone chamber comprises a tone chamber width defined by a distance between the interior surfaces of the side rails, the tone chamber width greater at the side rail top surface than at the bottom surface of the tone chamber; and the bottom surface comprises a bottom surface width defined by a distance between the interior surfaces of the side rails at the bottom surface, the bottom surface width varying from the second end of the tone chamber adjacent the tip rail to the first end of the tone chamber adjacent the table.

18. The woodwind mouthpiece of claim 17, wherein the tone chamber width is greater at the side rail top surface than at the bottom surface of the tone chamber along only a portion of an entire length of the tone chamber from the tip rail to the central bore.

19. The woodwind mouthpiece of claim 17, wherein the bottom surface width comprises a first width at the first end of the tone chamber, a second width at the second end of the tone chamber and a third width at a point along the tone chamber between the first end and the second end, the third width less than the first width and the second width, the bottom surface tapering from the first width to the third width and the third width to the first width and the point along the tone chamber disposed closer to the second end.

20. The woodwind mouthpiece of claim 17, wherein:

the tone chamber comprises a tapered cross section from side rail to side rail; and the bottom surface comprises a tapered shape from the first end to the second end.

* * * * *